US005802978A

United States Patent [19]

Geissler et al.

[11] Patent Number: 5,802,978

[45] Date of Patent: Sep. 8, 1998

[54] METHOD FOR REGULATING INKING WHEN PRINTING WITH A PRINTING PRESS

[75] Inventors: Wolfgang Geissler, Bad Schönborn; Harald Bucher, Eschelbronn; Werner Huber, Rauenberg; Bernd Kistler, Eppingen, all of Germany

[73] Assignee: Heidelberger Druckmaschinen AG, Heidelberg, Germany

[21] Appl. No.: 713,799

[22] Filed: Sep. 13, 1996

[30] Foreign Application Priority Data

Sep. 13, 1995 [DE] Germany ..... 195 33 822.7

[51] Int. Cl.[6] ..... B41F 31/04; B41F 31/06

[52] U.S. Cl. ..... 101/484; 101/485; 101/365

[58] Field of Search ..... 101/365, 350, 101/DIG. 45, DIG. 47, 484, 485, 483

[56] References Cited

U.S. PATENT DOCUMENTS 5,258,925 11/1993 Maier et al. .

FOREIGN PATENT DOCUMENTS 0 142 470 A1 5/1985 European Pat. Off. .
37 08 652 A1 9/1988 Germany .
43 35 229 A1 4/1995 Germany .
95/00336 1/1995 WIPO .

*Primary Examiner*—J. Reed Fisher
*Attorney, Agent, or Firm*—Herbert L. Lerner; Laurence A. Greenberg

[57] ABSTRACT

A method for regulating inking when printing with a printing press, which includes, by means of at least one sensor element directed towards the surface of a recording carrier at a given measurement site, deriving actual-value signals from at least one physical variable representing the inking; comparing the actual value signals with reference-value signals for the physical variable at the same measurement site; deriving, in accordance with a prescribed principle, control signals for control elements for the physical variable from the comparison-value signals obtained, and feeding the derived control signals to a control element; and placing the actual value in a range of reference values by means of the control element and holding it there automatically; further includes acting upon the control elements with defined control signals during a startup phase of the printing press; obtaining actual-value signals from a multiplicity of measurement sites in the entire printed surface of the recording carrier; determining, for each physical variable to be controlled and for each measurement site, changes in the actual-value signals with respect to the control signals to be defined; selecting measurement sites wherein the changes occur most markedly; and regulating the physical variables exclusively at the selected measurement sites, in a production-run phase of the printing press.

2 Claims, 2 Drawing Sheets

METHOD FOR REGULATING INKING WHEN PRINTING WITH A PRINTING PRESS

BACKGROUND OF THE INVENTION

FIELD OF THE INVENTION

The invention relates to a method for regulating inking when printing with a printing press. The goal in regulating the inking is to vary the operating procedures of the printing press in such a way as to produce printed materials which meet customer demands. In this regard, it is necessary, by means of scanner or sensor elements, to take off actual-value signals of physical quantities which describe the inking on a print carrier. Through the inking on the print carrier, a graphic copy is reproduced with the aid of the printing press. Examples of important physical quantities which offer a statement regarding the actual state of the inking or ink feeding are the normal color values X, Y, Z of a colorimetric normal observer. Spectral measurement devices, the operation of which is described in detail in the German Industrial Standards DIN 5033, are commonly used as scanner or sensor elements for normal color values.

The quality of the inking can be improved if a great number of measurement sites on the print material are selected which are representative of the inking. Especially in high-speed printing, a great amount of information representing the printed image is produced. The amount of information which can be generated, and the speed of transmission and processing, are limited by the technology of the sensor elements and the circuit arrangements connected thereto. Nor is this the only reason to limit the number of measurement sites.

In the published International Patent Document WO 95/00336 A2, a method has been described heretofore for automatically permitting suitable measurement sites to be found from the image signals. Both image signals obtained in the preprinting stage when the images to be printed are generated and image signals obtained during printing by means of a picture-taking device disposed in the printing press can be used. The image signals are fed to a computer system containing a program which assumes the task of automatically selecting the relevant measurement sites. With the aid of the program, an image to be printed is analyzed for identifying characteristics. For example, sites in the image to be printed wherein gray tones predominate, or wherein colors appear virtually in solo, i.e., alone, are ascertained. Suitable measurement sites are also found at locations in the image to be printed which exhibit sharp transitions in terms of contrast and color values.

This type of measurement site determination does not, however, take into account the characteristic dynamic controller properties of the printing press, such as the characteristic curve of the controller, the frequency response of the control elements disposed following the controller, or the dynamic behavior of the controller or the control elements if malfunctions occur. Thus, a measurement site selected solely in accordance with the image to be printed need not necessarily be optimal for regulating a given color or for regulating the dispensing of dampening medium.

In the published German Patent Document DE 40 05 558 A1, a method for process diagnosis of a rotary printing press is described wherein the cause for exceeding specified limit values is determined from the measured values for the remission, from full-tone and dot-matrix fields, and from the rates of change in the measured values. When the diagnosis produces certain results, the regulation is rendered inoperative. This method can be employed only if the printing has reached a stable state. The measurement sites are defined permanently and are limited to only a few full-tone and dot-matrix fields. Machine diagnosis is based solely on monitoring of the remission of the full-tone and dot-matrix fields. No provision is provided in this German Patent Document for monitoring the control of any other physical variables which affect the inking.

SUMMARY OF THE INVENTION

It is accordingly an object of the invention to provide a method of regulating inking when printing with a printing press wherein measurement sites which are the most suitable for regulating the inking are automatically found. It is a further object of the invention to take into account the characteristic dynamic controller properties of the printing press during the search for measurement sites. It is a further object of the invention to provide such a method which attains rapid regulation and an improvement in printing quality.

With the foregoing and other objects in view, there is provided, in accordance with the invention, a method for regulating inking when printing with a printing press, which includes, by means of at least one sensor element directed towards the surface of a recording carrier at a given measurement site, deriving actual-value signals from at least one physical variable representing the inking; comparing the actual-value signals with reference-value signals for the physical variable at the same measurement site; deriving, in accordance with a prescribed principle, control signals for control elements for the physical variable from the comparison-value signals obtained, and feeding the derived control signals to a control element; and placing the actual value in a range of reference values by means of the control element and holding it there automatically; which comprises acting upon the control elements with defined control signals during a startup phase of the printing press; obtaining actual-value signals from a multiplicity of measurement sites in the entire printed surface of the recording carrier; determining, for each physical variable to be controlled and for each measurement site, changes in the actual-value signals with respect to the control signals to be defined; selecting measurement sites wherein the changes occur most markedly; and regulating the physical variables exclusively at the selected measurement sites, in a production-run phase of the printing press.

The invention is based upon a simulation of control events during the startup phase of the printing press. Once all the essential control elements in the printing press have been preset and the first printed materials have been produced, the actual-value signals for all the physical variables to be regulated are ascertained by a pixel-by-pixel, full-surface scanning and are stored in storage memory in a control unit. The sensor elements are adapted or set to the particular physical variable. The amounts and direction of the defined control signals are known in advance and are likewise stored in storage memory in the control unit.

To limit the quantity of data to be processed in the control unit, it is possible to exclude from the printed product those measurement sites which, for technical-process reasons and because of the layout, are not supposed to be printed. For example, by means of image processing, one can identify areas with nonrelevant image locations in the printed product which are cut off during further processing or which, in a sheet-fed printing press, form a so-called gripper edge, by which the sheets are fed through the press by means of grippers.

After the control elements for the physical variables have been acted upon by the corresponding defined control signals, the actual-value signals are re-determined at the same measurement sites for at least one subsequent print run. By comparing the actual-value signals from print runs before and after the imposition of the defined control signals, those measurement sites which react the most sensitively to the defined control signals are ascertained. The coordinates of these measurement sites are stored in storage memory in the control unit. In later print runs, the ascertainment of actual values and regulation of the physical variables are undertaken only at these selected measurement sites.

In another mode of the method according to the invention, the defined control signals can be generated by a human operator and transferred manually to the control signals.

If the actual values are generated as colorimetric actual values, the measured color changes correspond to the changes which an observer would notice in the printed image.

Regulation of the color at the automatically ascertained measurement sites cannot be set into operation until the difference between the actual values and specified desired or reference values exceeds a limit value which, in turn, exceeds the threshold of detectability of the human eye for color changes.

Other features which are considered as characteristic for the invention are set forth in the appended claims.

Although the invention is illustrated and described herein as embodied in a method for regulating inking when printing with a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
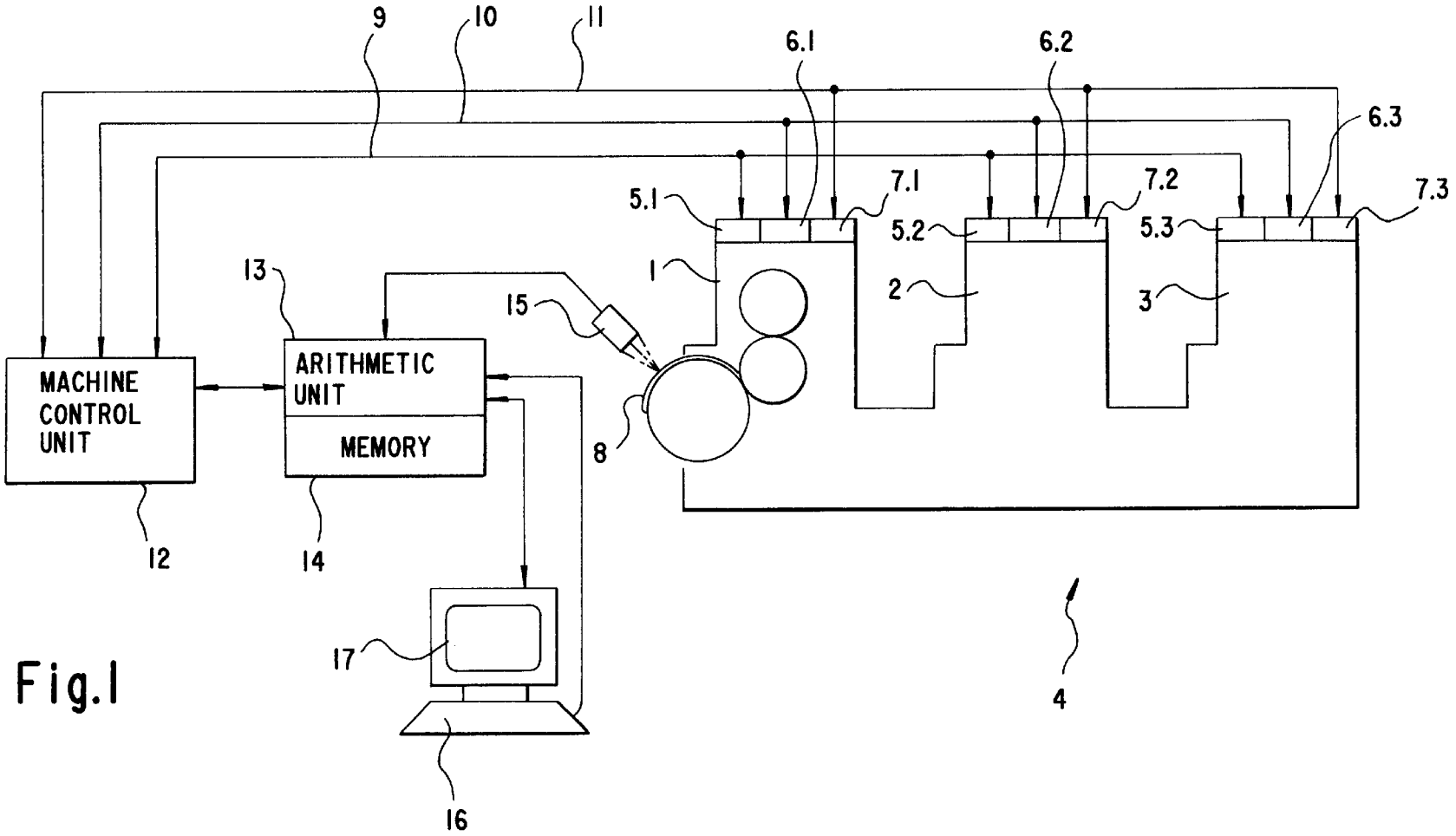
FIG. 1 is a diagrammatic and schematic view of a control or regulating arrangement for printing with an offset printing press.

Referring now to the drawings and, first, particularly to FIG. 1 thereof, there are shown therein printing units 1, 2 and 3 of an offset sheet-fed printing press 4, respectively, having control elements 5.1, 5.2 and 5.3; 6.1, 6.2 and 6.3; and 7.1, 7.2 and 7.3 for various physical variables, which directly affect the inking on a sheet 8. The zonally acting control elements 5.1, 5.2 and 5.3 for the layer thickness of the printing ink, the control elements 6.1, 6.2 and 6.3 for the quantity of dampening medium, and the control elements 7.1, 7.2 and 7.3 for the register are connected via respective lines 9, 10 and 11 to a control unit 12. The control unit 12 is connected to a digital or calculating unit 13, which includes a memory unit 14 with a reference or desired-image storage memory and an actual-image storage memory. The digital or calculating unit 13 is also connected to a picture-taking unit 15, to a keyboard 16 and to a screen 17. The picture-taking unit 15 is disposed at the last printing unit 1, and covers or detects the entire printed surface of the sheet 8.

Figure 2:
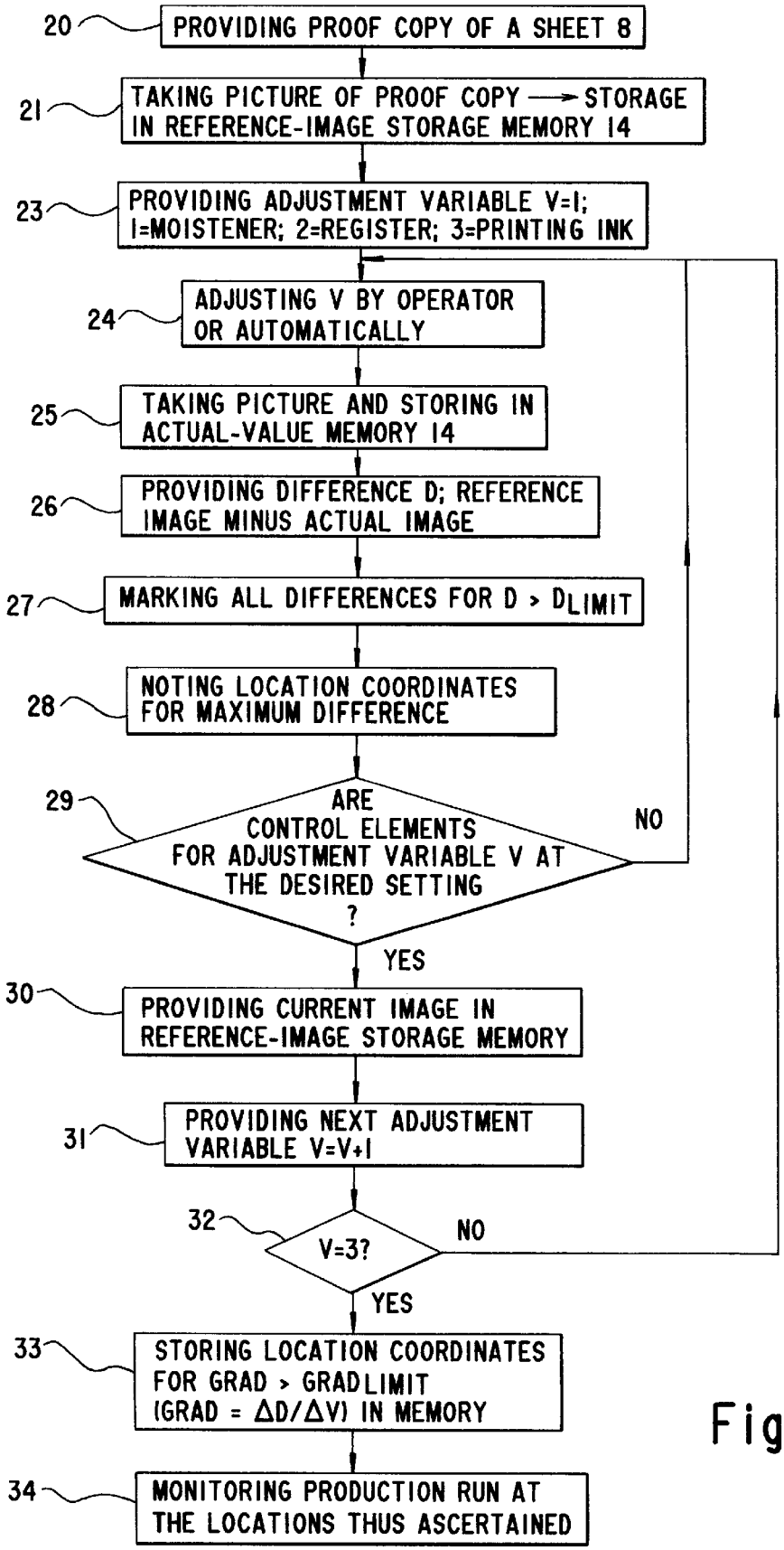
FIG. 2 is a flow chart for finding the measurement sites.

How the method according to the invention can be performed with the arrangement described in conjunction with FIG. 1 will be explained hereinafter with reference to FIG. 2.

In a first step 20, a first sheet is printed with the previously preset offset sheet-fed printing press 4. The resultant printed image is scanned over the entire surface area thereof in a second step 21 by the picture-taking unit 15. The signals which represent the printed image are fed to the calculating unit 13. From these actual-value signals, desired or reference color values for many measurement sites are derived and stored in a reference-image storage memory 14. The measurement sites for obtaining the reference-value signals may be distributed uniformly over the surface of the sheet 8 in a dot matrix made up of rows and columns. In a further step 23, a controlled variable counter is set to 1, so that all subsequent steps are referred to a first physical variable quantity to be controlled. In this exemplary embodiment, the control elements 5.1, 5.2 and 5.3 for the proportional component of dampening medium in the printing-ink/dampening-medium mixture on the plate cylinder of each of the printing units 1 to 3 is addressed by V=1.

In a next step 24, the control elements 5.1, 5.2 and 5.3 for the dampening medium are adjusted by predetermined variables. The control variables may be generated by the calculating or arithmetic unit 13 and fed to the control elements 5.1, 5.2 and 5.3 via the machine control unit 12, or they can be input manually, to which end an operator of the offset sheet-fed printing press 4 makes entries into the calculating or arithmetic unit 13 accordingly, via the keyboard 15. The control variables may be transferred to all of the printing units 1 to 3 simultaneously, or may be transferred with a time lag. The control variable transferred to the control elements 5.1, 5.2 and 5.3 effect a variation in the inking on the sheet 8.

The variation in the inking is detected by the picture-taking unit 15. In a step 25, actual color values are derived from the signals representing the printed image, and stored in an actual-image storage memory. In the next step 26, the differences D between the actual and desired or reference color values are formed for each measurement site, with the aid of the calculating or arithmetic unit 13. In the following step 27, the differences D which exceed a limit value $D_{LIMIT}$ are ascertained and, in the next step 28, the location coordinates of the measurement sites wherein a limit value has been exceeded are recorded. In a further step 29, the operator of the offset sheet-fed printing press 4 checks whether the control elements 5.1, 5.2 and 5.3 for the first physical variable to be controlled have been set in such a manner or so far that the process can be continued. The operator has the capability of readjusting the control elements 5.1, 5.2 and 5.3 manually again, until the settings are capable of being used for continuing the process. Thereafter, in a step 30, a printed image produced with these settings of the control elements 5.1, 5.2 and 5.3 is stored in storage memory as the current printed image in the reference or desired-image storage memory 14. In a step 31, the controlled variable counter is incremented by 1, so that when the question raised in a step 32 whether simulation has been effected yet with all the control variables is answered in the negative, the method is repeated from step 24 on for the remaining control elements 6 and 7. After the simulation of the inking has been performed with all the control variables, in a step 33, the measurement sites in which a gradient (grad) of the color change exceeds a predetermined limit value ($grad_{LIMIT}$) are determined for all the measurement sites recorded in step 28.

Finally, the production run can be performed in a step 34, in regard to which, the only locations at which the color values have to be obtained with the aid of the picture-taking unit 15 are the measurement sites determined in step 33.

We claim:

1. In an inking control method for a printing machine wherein inking is controlled on the basis of given measurement sites on a recording carrier, a method of selecting the measurement sites for regulating inking during printing with the printing machine, which comprises:

providing a printing press having control elements for adjusting inking of a printed image;

printing a first printed image onto a recording carrier;

defining a multiplicity of measurement sites on an entire printed area of the first printed image on the recording carrier;

ascertaining, with at least one sensor element, first actual value signals representing a coloration and position of the coloration of the first printed image from the multiplicity of measurement sites;

defining control signals for adjusting the control elements for controlling the inking;

adjusting the control elements with the control signals;

subsequently printing with the control elements adjusted according to the control signals a second printed image, deriving second actual value signals representing the coloration and position of the coloration of the second printed image, comparing the first actual value signals with the second actual value signals, and determining differences between the first actual value signals and the second actual value signals for each measurement site; and selecting, in a subsequent inking control process, those measurement sites at which the differences are the greatest.

2. The method according to claim 1, which comprises defining control signals for the control elements to adjust at least one of an ink layer thickness, a quantity of dampening medium and register errors by the control elements.

* * * * *